United States Patent [19]

Seiden

[11] 3,988,255

[45] Oct. 26, 1976

[54] TOILET BARS

[75] Inventor: Paul Seiden, Cincinnati, Ohio

[73] Assignee: The Procter & Gamble Company, Cincinnati, Ohio

[22] Filed: Dec. 15, 1975

[21] Appl. No.: 640,660

Related U.S. Application Data

[63] Continuation-in-part of Ser. No. 555,516, March 5, 1975, abandoned.

[52] U.S. Cl. ..... 252/107; 252/117; 252/132; 252/DIG. 5; 252/DIG. 16

[51] Int. Cl.[2] ..... C11D 9/26

[58] Field of Search ..... 252/132, 117, 107, DIG. 5, 252/DIG. 16

[56] References Cited

UNITED STATES PATENTS

| | | | |
|---|---|---|---|
| 2,478,820 | 8/1949 | Griffin | 260/410.6 |
| 2,676,152 | 4/1954 | Fortess et al. | 252/132 |
| 2,697,695 | 12/1954 | McDonald | 252/116 |
| 3,155,624 | 11/1964 | Kelly | 252/125 |
| 3,557,006 | 1/1971 | Ferrara et al. | 252/117 |
| 3,708,435 | 1/1973 | Starkman | 252/544 |

*Primary Examiner*—Harris A. Pitlick
*Attorney, Agent, or Firm*—George W. Allen; Douglas C. Mohl; Richard C. Witte

[57] ABSTRACT

Incorporation of particular amounts of certain sorbitan ester mixtures into toilet bars provides products which produce desirable skin benefits. Toilet bars containing these sorbitan ester materials help provide a smooth, soft texture to the skin cleaned therewith and further help to reduce skin scaliness.

11 Claims, No Drawings

TOILET BARS

CROSS-REFERENCE TO RELATED APPLICATION

This application is a continuation-in-part application of U.S. application Ser. No. 555,516, filed Mar. 5, 1975, and now abandoned entitled "Toilet Bars."

BACKGROUND OF THE INVENTION

The present invention relates to skin conditioning toilet bars. Such bars contain certain mixtures of sorbitan esters combined with conventional soap compounds. These sorbitan ester materials are delivered to the skin via the toilet bar vehicle.

Cleansing of the human skin with surface active materials is a procedure which generally occurs with great frequency. Unfortunately, many of the surface active materials (including soap) used to cleanse skin tend to remove natural oils from the skin and therefore can produce undesirable skin dryness, roughness, irritation or scaliness. Similar such undesirable skin problems caused by weather, working conditions, exposure to chemicals and the like can also be aggravated by cleansing the skin with compositions containing surface active agents.

Accordingly, there have been many attempts to alleviate the harshness of skin cleansing products by incorporating a wide variety of mildness additives into such products. Thus, emollient oils and skin conditioners have long been added to skin products such as soap to improve skin feel both during and after washing. Generally, such skin conditioners are designed to minimize such undesirable skin problems as irritation, redness, dryness and looseness of the skin.

Materials which provide relief from some of these skin sensation problems do not, however, necessarily alleviate related problems such as skin roughness and scaliness. There is, accordingly, a continuing need for skin care products containing mildness additives which help reduce skin roughness and scaliness and which impart a desirable smooth, soft feel to skin treated therewith.

In accordance with the present invention, certain sorbitan ester mixtures have been incorporated into toilet bars as mildness additives. It is believed that sorbitan ester materials deposit onto skin from the toilet bars herein to provide a protective lipid film.

Sorbitan esters and related materials are known emulsifiers and suds control agents which have been utilized in cosmetic and soap formulations. For example, Ferrara et al.; U.S. Pat. No. 3,557,006; issued Jan. 19, 1971 discloses acidic soap bars which contain low levels of sorbitan monostearate in addition to specific skin conditioning agents. Griffin; U.S. Pat. No. 2,478,820; issued Aug. 9, 1949 discloses lanolin-containing cosmetic compositions which also contain certain sorbitan ester materials. Fortess et al., U.S. Pat. No. 2,676,152; issued Apr. 20, 1954 discloses aqueous soap solutions containing certain sorbitan ester materials as emulsifying agents. Starkman, U.S. Pat. No. 3,708,436, issued Jan. 2, 1973, discloses a variety of polyurethane-containing skin treating compositions; some of these compositions contain sorbitan esters as plasticizers. McDonald, U.S. Pat. No. 2,697,695, issued Dec. 21, 1954, discloses controlled-suds washing compositions containing soap and ethoxylated sorbitan esters. None of these references indicate that the sorbitan ester materials employed are in any way useful as skin conditioning agents.

In view of the foregoing, it is an object of the present invention to provide toilet bars which both cleanse and condition the skin during and after use.

It is a further object of the present invention to provide a method of simultaneously cleaning and treating the skin with materials that reduce skin scaliness and impart a smooth, soft texture and feel to the skin so treated.

It has been surprisingly discovered that by incorporating certain sorbitan ester mixtures into conventional soap-containing toilet bars at certain concentrations, the above-described objectives can be realized and toilet bars provided which are unexpectedly superior to similar skin treating products of the prior art.

SUMMARY OF THE INVENTION

In its broadest composition aspect, the instant invention relates to skin conditioning toilet bars which comprise from about 65% to 90% by weight of a soap component, from about 1% to 15% by weight of a sorbitan ester mixture and from about 4% to 25% by weight of moisture.

The soap component can comprise the alkali metal, ammonium and/or alkanolamine salts of fatty acids containing from 8 to 24 carbon atoms.

The sorbitan ester mixtures contain the fatty alkyl esters of 1,4-, 3,6-, 2,5- and 1,5-sorbitan with the fatty alkyl group containing from about 12 to 22 carbon atoms. Such mixtures comprise from about 5% to 50% by weight of mixture of a mono-ester component, from about 20% to 90% by weight of mixture of a di-ester component and from 0% to 75% by weight of mixture of a tri-ester and tetra-ester components.

In its method aspect, the present invention relates to a method of applying a soap formulation to the skin to impart certain skin conditioning benefits. The soap formulation is applied from a toilet bar similar to that described above but which can contain either ethoxylated or non-ethoxylated sorbitan ester materials.

DETAILED DESCRIPTION OF THE INVENTION

The toilet bars of the present invention essentially contain a soap component, a sorbitan ester skin conditioning component and moisture. Each of these components as well as optional ingredients, bar manufacture, and bar use are described in detail as follows:

THE SOAP COMPONENT

The toilet bars of the instant invention comprise from about 65% to 90% by weight, preferably from about 70% to 80% by weight, of a soap component. Soaps useful in the present invention include the alkali metal, ammonium and alkanolamine salts of fatty acids containing from about 8 to 24, preferably 10 to 20, carbon atoms.

Suitable fatty acids can be obtained from natural sources such as, for instance, plant or animal esters (e.g., palm oil, coconut oil, babassu oil, soybean oil, castor oil, tallow, whale and fish oils, grease, lard, and mixtures thereof). The fatty acids also can by synthetically prepared (e.g., by the oxidation of pertroleum, or by hydrogenation of carbon monoxide by the Fischer-Tropsch process). Resin acids are suitable such as rosin and those resin acids in tall oil. Naphthenic acids are also suitable.

Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with fatty acid mixtures having an approximate carbon chain length distribution of 2.5% $C_{14}$, 29% $C_{16}$, 23% $C_{18}$, 2% palmitoleic, 41.5% oleic and 3% linoleic (the first three fatty acids listed are saturated). Other mixtures with similar distribution, such as the fatty acids derived from various animal tallows and lard, are also included within the term tallow.

When the term "coconut oil" is used herein it refers to fatty acid mixtures having an approximate carbon chain length distribution of: 8% $C_8$, 7% $C_{10}$, 48% $C_{12}$, 17% $C_{14}$, 9% $C_{16}$, 2% $C_{18}$, 7% oleic, and 2% linoleic (the first six fatty acids listed being saturated). Other sources having similar carbon chain length distribution such as palm kernel oil and babassu kernel oil are included within the term coconut oil. Coconut oil fatty acids ordinarily have a sufficiently low content of unsaturated fatty acids to have satisfactory keeping qualities without further treatment. As is customary, however, the fatty acids are hydrogenated to decrease the amount of unsaturation (especially polyunsaturation) of the fatty acid mixture listed above.

In preferred toilet bars of the present invention, the soap component is either sodium soap or a mixture of sodium and potassium soap wherein the mixture contains no more than about 25% by weight potassium soap.

Also in such preferred bars, the total soap component comprises (a) from about 20% to 80% by weight of the soap component of a mixture containing soaps having from 8 to 14 carbon atoms and (b) from about 20% to 80% by weight of the soap component of soaps having from about 16 to 20 carbon atoms.

Soaps having such preferred chain length distribution characteristics can be realized by utilizing mixtures of tallow and coconut fatty acids in tallow/coconut weight ratios varying between 90:10 and 50:50.

Preferred toilet bars containing the above-described particular soap mixtures, as well as their manufacture, are described in more detail in Megson et al., U.S. Pat. No. 3,576,749, issued Apr. 27, 1971, and White, U.S. Pat. No. 3,835,058, issued Sept. 10, 1974. Both of these patents are incorporated herein by reference.

SORBITAN ESTER SKIN CONDITIONING COMPONENT

The sorbitan ester skin conditioning agents employed in the toilet bars of the present invention comprise the esterified dehydration products or sorbitol. Sorbitol, itself prepared by the catalytic hydrogenation of glucose, can be dehydrated in well-known fashion to form mixtures of 1,4-, 3,6-, 2,5- and 1,5-sorbitol ahydrides (and small amounts of isosorbides). For example, the 1,4- amd 1,5- anhydrides can be formed according to the following reaction: (See Brown, U.S. Pat. No. 2,322,821, issued June 29, 1943)

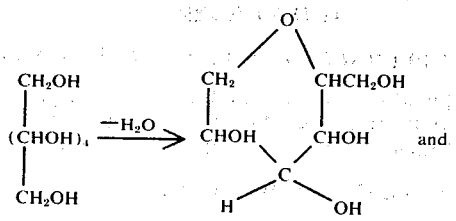

Sorbitol 1,5-Sorbitan

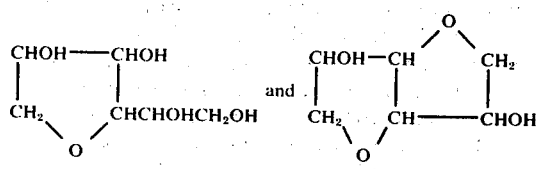

1,4-Sorbitan Isosorbide

The foregoing complex mixtures of anhydrides of sorbitol are collectively referred to herein as "sorbitan". It will be recognized that this sorbitan mixture will also contain some free, acyclic sorbitol.

Skin conditioning agents of the type employed herein can be prepared by esterifying the sorbitan mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions.

For commercial production of sorbitan ester materials, etherification and esterification are generally accomplished in the same processing step by reacting sorbitol directly with fatty acids. Such a method of sorbitan ester preparation is described more fully in MacDonald, "Emulsifiers: Processing and Quality Control", *Journal of the American Oil Chemists' Society, Volume* 45, October, 1968.

Mixtures of sorbitan mono-, di-, and tetra-esters are preferred skin conditioners in the present invention. Such mixtures appear to impart a greater degree of skin smoothness and scale reduction when applied to the skin in toilet bars of the present invention.

The mixtures of hydroxy-substituted sorbitan esters useful herein contain, inter alia, di-ester compounds of the following formulae, as well as some of the corresponding mono-esters, tri-esters, etc.

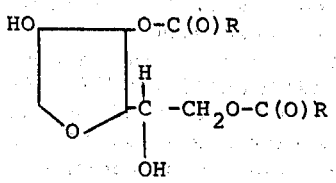

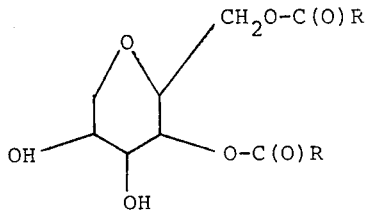

and

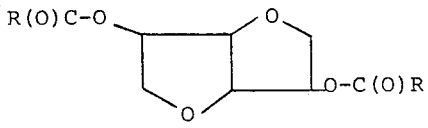

wherein the group RC(O)— is a $C_{12}$–$C_{22}$, and higher, fatty alkyl residue. Preferably this fatty alkyl residue contains from 16 to 18 carbon atoms. The fatty alkyl residue can, of course, contain non-interferring substituents such as hydroxyl groups. Esterified hydroxyl groups can be either in terminal or internal positions within the sorbitan molecule.

The foregoing complex mixtures of esterified dehydration products of sorbitol (and small amounts of esterified sorbitol) are collectively referred to herein as "sorbitan esters". Sorbitan mono- and di-esters of myristic, palmitic and stearic acids are particularly useful herein for imparting a soft, smooth feeling to skin. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{12}$–$C_{22}$ sorbitan esters, e.g., sorbitan monooleate, usually are present in such mixtures in low concentration. The term "alkyl" as employed herein to describe the sorbitan esters encompasses both the saturated and unsaturated hydrocarbyl ester side chain groups, but the predominant portion is saturated.

It will be recognized that certain sorbitan esters herein can be either ethoxylated or non-ethoxylated. The "lower" sorbitan ester ethoxylates (i.e., mono-, di-, tri- and tetra-esters wherein one or more of the -OH groups contain one to about 10 oxyethylene moieties) [Tweens] are useful in providing the desired skin benefits when applied via the toilet bars of the present invention. For purposes of the instant invention, the term "ethoxylated sorbitan ester" includes those sorbitan ester materials containing from one to 10 oxyethylene moieties at one or more of the unesterified —OH groups. Blends of ethoxylated and nonethoxylated sorbitan esters are preferred compositions of the present invention, particularly those wherein the ratio of ethoxylated material to nonethoxylated material varies from about 1:3 to 3:1.

Preparation of the sorbitan esters herein can be achieved by dehydrating sorbitol to form a mixture of anhydrides of the type set forth above, and subsequently esterifying the mixture, for example, using a 1:1 stoichiometry for the esterification reaction. The esterified mixture can then be separated into the various ester components. Separation of the individual ester products is, however, difficult and expensive. Accordingly, it is easier and more economical not to separate the various esters, using instead the total esterified mixture as the sorbitan ester component. Such mixtures of esterified reaction products are commercially available under various trade names, e.g., Span and Glycomul. Such sorbitan ester mixtures can also be prepared by utilizing conventional interesterification procedures.

The preferred alkyl sorbitan esters for use in the toilet bars herein include mixtures of sorbitan monomyristate, sorbitan monopalmitate and sorbitan monostearate with sorbitan dimyristate, sorbitan dipalmitate and sorbitan distearate. Preferred sorbitan ester mixtures include mixed saturated stearic and palmitic acid sorbitan mono- and di-esters. Such mixtures are readily prepared by reacting the foregoing hydroxy-substituted sorbitans, particularly the 1,4- and 1,5- sorbitans, with the corresponding acid or acid chloride in a simple esterification reaction. It is to be recognized, of course, that commercial materials prepared in this manner will comprise mixtures containing some proportion of various tri-esters, tetra-esters, uncyclized sorbitol, fatty acids, polymers, isosorbide ester structures and the like. It is, however, preferred that isosorbide ester content be limited to 6% or less by weight of the sorbitan ester mixtures and sorbitol ester content be limited to 15% or less by weight of the sorbitan ester mixtures.

For purposes of the present invention, operable skin conditioning agents are those sorbitan ester mixtures which comprise from about 5% to 50% by weight of the mixture of the mono-ester component; from about 20% to 90% by weight of the mixture of the di-ester component and from about 0% to 75% by weight of the mixture of the tri-ester and tetra ester components. More preferably such mixtures contain from about 20% to 40% by weight of the mono-ester component; from about 30% to 60% by weight of the di-ester component and from about 0% to 40% by weight of the tri- and tetra-ester components. Highly preferred materials include mixtures of the mono- and di-tallow alkyl esters of 1,4-, 3,6, 2,5- and 1,5-sorbitan.

It is to be recognized that the sorbitan esters from commercial sources, as well as those made in the manner disclosed herein, can contain up to about 15% by weight of esters of acids having a chain length of up to $C_{26}$, and greater, as well as some lower saturated ($C_{8-10}$) acids. These materials can be present in the sorbitan mixtures used herein so long as the requisite concentrations of essential components are present as discussed above. The sorbitan ester component described above is generally present in the instant toilet bars herein to the extent of from about 1% to 15% by weight, preferably from about 4% to 8% by weight, of the bar.

MOISTURE

The toilet bars of the present invention inevitably contain some moisture (water). Moisture aids in the processing of the toilet bars herein and is required for optimum processing conditions. Generally the finished toilet bars of this invention contain from about 4% to 25% by weight moisture, preferably from about 10% to 23% by weight moisture.

OPTIONAL COMPONENTS

Besides the essential soap, sorbitan ester and moisture components described above, the toilet bars of the present invention can contain a wide variety of optional materials. These optional materials include, for example, free fatty acids, processing aids, antibacterial agents and sanitizers, additional emollients and skin conditioning agents and perfumes, dyes and coloring agents.

FREE FATTY ACID

The toilet bars of the present invention can optionally contain free fatty acid in addition to the neutralized fatty acids which form the essential soap component. Free fatty acids improve the volume and quality of the lather from the bar, especially the quality. Free fatty acids tend to cause the lather to be more stable with small air bubbles which give the user a lather which is characterized as "richer" and creamier. The fatty acids also tend to help soften the skin when used in combination with the sorbitan ester skin conditioning materials. Lastly and very importantly in a bar which contains large amounts of salt, the free fatty acids are plasticizers. Without the free fatty acids, some bars have a greater tendency to form wet cracks.

Free fatty acids which can optionally be used in "superfatted" toilet bars of the present invention include the same types of fatty acids used to form the soap component. Such fatty acids generally contain from 8 to 20 carbon atoms, preferably from 8 to 14 carbon atoms. In preferred toilet bars herein, at least 25% of the free fatty acid component is the $C_{12}$ fatty acid. Coconut fatty acid is most preferred.

If present, free fatty acid generally comprises from about 1% to 15% by weight of the bar. Use of free fatty acid in soap bars is described in more detail in Megson et al., U.S. Pat. No. 3,576,749, issued Apr. 27, 1971, and White, U.S. Pat. No. 3,835,058, issued Sept. 10, 1974. Both of these patents are incorporated herein by reference.

PROCESSING AIDS

Materials to facilitate preparation of the instant toilet bars can also be optionally present. Thus, salt (sodium chloride) and/or glycerine, for example, can be added to the crutcher or amalgamator in order to facilitate processing of the soap bars. Such materials, if present, generally comprise from about 0.2% to 5% by weight of the finished toilet bar. Additionally, emulsifiers such as polyglycerol esters (e.g., polyglycerol monostearate), propylene glycol esters and other chemically stable nonionic materials may be added to the bars herein to help in solubilizing the sorbitan ester materials. If said emulsifiers are present they are present in a weight ratio of from about 50:50 to about 90:10 sorbitan ester:emulsifier.

ANTIBACTERIAL AGENTS AND SANITIZERS

Conventional anti-bacterial agents and sanitizers can be added to the toilet bars of the present invention without adversely effecting the skin conditioning properties of the bars. Typical antibacterial sanitizers include 3,4-di- and 3,4',5-tri-bromosalicylanilides; 4,4'-dichloro-3-(trifluoromethyl)carbanilide; 3,4,4'-trichlorocarbanilide and mixtures of these materials. Use of these and related materials in toilet bars is described in more detail in Reller et al.; U.S. Pat. No. 3,256,200; issued June 14, 1966, incorporated herein by reference.

If present, antibacterial agents and sanitizers generally comprise from about 0.5% to 4% by weight of the finished toilet bars.

ADDITIONAL EMOLLIENTS AND SKIN CONDITIONING AGENTS

Besides the essential sorbitan ester skin conditioning agents described above, the toilet bars herein can optionally contain additional emollients and skin conditioning agents. Known materials of this type include, for example, lanolin, cold cream, mineral oil, isopropyl myristate and similar materials.

If present, such additional emollients and skin conditioning agents generally comprise from about 0.5% to 5% by weight of the toilet bar.

PERFUMES, DYES AND COLORING AGENTS

The toilet bars of the present invention can contain any of the conventional perfumes, dyes and coloring agents generally utilized in commercially marketed toilet bars to improve the aesthetic characteristics of such products.

If present, such perfumes, dyes and coloring agents comprise from about 0.2% to 5% by weight of the toilet bar.

BAR MANUFACTURE

The toilet bars of the present invention are prepared in conventional manner. Moisture-containing base soap of the type described above is admixed with the sorbitan ester skin conditioning agents and other optional ingredients such as perfumes in a crutcher or amalgamator, milled in conventional manner under conventional conditions and extruded into logs for stamping into toilet bars. Preferably the sorbitan ester agents are comelted with the base soap before being introduced into the crutcher or amalagamator. Conventional processes for preparing aerated soap bars can also be utilized.

Manufacturing processes for preparing toilet bars of the type claimed herein are described in more detail in White; U.S. Pat. No. 3,835,058; issued Sept. 10, 1974; Megson et al.; U.S. Pat. No. 3,576,749; issued Apr. 27, 1971; and Bradley et al.; U.S. Pat. No. 3,523,909; issued Aug. 11, 1970. All of these patents are incorporated herein by reference.

BAR UTILIZATION

The toilet bars of the present invention are used to cleanse and help condition the skin. Small amount of the soap composition from the bars are dissolved with water and topically applied to the skin either by hand or with a washrag. Skin is generally rinsed with water after application of the soap composition from the bar. When dissolved in water, the soap compositions from the toilet bars herein provide solutions having an alkaline pH.

The toilet bars of the present invention and their usefulness in conditioning the skin are demonstrated by the following Examples.

EXAMPLE I

Utilizing the process described in Megson et al., U.S. Pat. No. 3,576,749; issued Apr. 27, 1971, a toilet bar of the following composition is prepared.

| COMPONENT | Wt. % |
|---|---|
| Sodium tallow/coconut soap (50:50 tallow/coconut) | 59.35 |
| Potassium tallow/coconut soap (50:50 tallow/coconut) | 15.88 |
| Glycomul S* Sorbitan Ester Mixture | 4.00 |
| 24.8% Sorbitan mono-ester | |
| 33.1% Sorbitan di-ester | |
| 27.7% Mixture sorbitan tri- and tetra-esters | |
| 14.4% Unreacted materials | |
| Free Coconut Fatty Acid | 6.73 |
| Cold Cream | 1.06 |
| NaCl | 1.06 |
| Perfume and Miscellaneous | 1.54 |
| Moisture | 10.38 |
| | 100.00% |

*Product Marketed by Glyco Chemicals, Inc.

Toilet bars of this formulation help provide a smooth skin texture and reduced skin scaliness when used to cleanse skin in conventional manner.

A toilet bar having similar skin conditioning properties is realized when in the above-described Example I composition, the Glycomul S sorbitan ester mixture is replaced with an equivalent amount of Tween 61, a commercially-available ethoxylated sorbitan ester mixture containing the requisite mono- and di- ester content. Tween 61 is marketed by the Atlas Chemicals Division of ICI America, Inc.

An antibacterial bar having similar skin conditioning properties is realized when the above-described toilet bar additionally contains about 0.5% by weight of a sanitizer mixture of 4,4-dichloro-3-(trifluoromethyl)-carbanilide and 3,4,4'-trichlorocarbanilide.

EXAMPLE II

Utilizing the process described in White, U.S. Pat. No. 3,835,058, issued Sept. 10, 1974, an aerated toilet bar of the following composition is prepared.

| COMPONENT | WT. % |
|---|---|
| Sodium Tallow/Coconut Soap (70:30 tallow/coconut) | 58.8 |
| Potassium Tallow/Coconut Soap (70:30 tallow/coconut) | 15.6 |
| Tween 61* | 4.0 |
| NaCl | 0.69 |
| Perfume and Miscellaneous | 0.21 |
| Moisture | 20.7 |
| | 100.00% |

*A commercial ethoxylated sorbitan ester mixture marketed by the Atlas Chemicals Division of ICI America, Inc.

Toilet bars of this formulation provide a smooth, soft skin texture and reduced skin scaliness when used to cleanse skin in conventional manner.

A toilet bar having similar skin conditioning properties is realized when in the above-described Example II composition, the Tween 61 sorbitan ester mixture is replaced with an equivalent amount of Glycomul S.

SMOOTHNESS/SOFTNESS EVALUATION PROCEDURE

The ability of the toilet bars of the present invention to provide softness and smoothness skin benefits is evaluated by means of the following procedure.

Panels of ten members are formed to grade the effects of skin treatment with pairs of toilet bars. Each panelist's arms are washed two or three times each day, one arm being washed with a control bar containing no skin conditioning additive, the second arm being washed with the test bar containing sorbitan ester materials. The arms are washed with warm (100° F ± 5° F) water for 30 seconds (20 seconds in contact with the bar and ten seconds of additional lathering). Each arm is then rinsed thoroughly and dried. Panelists are asked to feel each arm and express their perception of softness/smoothness difference between the arm treated with the control bar and the arm treated with the test bar. Grading is done several times each day.

Using this procedure softness/smoothness effects of toilet bars similar to the bars of Examples I and II are compared with control bars. The control bars have formulations similar to the Examples I and II bars with the sorbitan ester materials removed.

In multiple tests to evaluate panelists' preferences concerning a "softer, smoother feel" provided by either the test or control bars, the following results are obtained:

Test No. 1

| Response | % of Total Response |
|---|---|
| Prefer Bar similar to Example I containing Glycomul S Sorbitan Ester Mixture | 57% |
| Prefer Bar similar to Example I with Glycomul S Removed | 28% |
| No Preference | 15% |
| | 100% |

Test No. 2

| Response | % of Total Response |
|---|---|
| Prefer Bar similar to Example II containing Tween 61 Ethoxylated Sorbitan Ester Mixture | 45% |
| Prefer Bar similar to Example II with Tween 61 Removed | 26% |
| No Preference | 29% |
| | 100% |

Such softness/smoothness evaluations indicate that toilet bars of the instant invention can provide a perceptible softness/smoothness benefit when used to cleanse skin in conventional manner. When pure sorbitan mono-esters are utilized in soap bars and evaluated in accordance with the above procedure, no directional skin smoothness/softness benefits are perceived by the panelists.

What is claimed is:

1. A toilet bar suitable for providing a soft, smooth skin texture after use, said bar comprising:

a. from about 65% to 90% by weight of a soap selected from the group consisting of alkali metal, ammonium, and alkanolamine salts of fatty acids containing from about 8 to 24 carbon atoms;

b. from about 1% to 15% by weight of a mixture of non-ethoxylated sorbitan esters, said ester mixture comprising:

i. from about 5% to 50% by weight of mixture of mono-ester materials, ii. from about 20% to 90% by weight of mixture of di-ester materials, and iii. from about 0% to 75% by weight of mixture of tri- and tetra-ester materials; the ester moieties in said sorbitan ester materials being derived from fatty alkyl groups containing from about 12 to 22 carbon atoms; and c. from about 4% to 25% by weight of moisture.

2. A toilet bar in accordance with claim 1 wherein a. the soap is selected from the group consisting of alkali metal soaps containing from 10 to 20 carbon atoms; and b. the sorbitan ester mixture comprises i. from about 20% to 40% by weight of mixture of mono-ester materials;

ii. from about 30% to 60% by weight of mixture of di-ester materials; and iii. from about 0% to 40% by weight of mixture of tri- and tetra-ester materials.

3. A toilet bar in accordance with claim 2 wherein the soap comprises from about 70% to 80% by weight and is selected from the group consisting of sodium soap and mixtures of sodium and potassium soap, said sodium/potassium soap mixtures containing no more than about 25% potassium soap.

4. A toilet bar in accordance with claim 3 a. wherein the soap component comprises mixtures of tallow and coconut soaps with tallow/coconut weight ratios within such mixtures varying between 90:10 and 50:50; and b. wherein the sorbitan ester mixture comprises from about 4% to 8% by weight of the bar.

5. A toilet bar in accordance with claim 4 wherein the sorbitan ester mixture contains 15% or less by weight of the mixture of isosorbide ester structures and 10% or less by weight of the mixture of sorbitol ester.

6. A toilet bar in accordance with claim 5 which additionally contains from about 1% to 15% by weight of free fatty acids containing from 8 to 20 carbon atoms.

7. A toilet bar in accordance with claim 5 which additionally contains from about 0.5% to 5% by weight of a skin conditioning agent selected from the group consisting of lanolin, cold cream, mineral oil and isopropyl myristate.

8. A toilet bar in accordance with claim 5 which additionally contains from about 0.5% to 4% by weight of an antibacterial sanitizer component.

9. A toilet bar in accordance with claim 1 which additionally contains an ethoxylated sorbitan ester mixture containing from one to 10 oxyethlene moieties at one or more of the unesterified —OH groups, the ester materials in said mixture being the same as indicated for the non-ethoxylated mixture therein, such that the weight ratio of the non-ethoxylated mixture to the ethoxylated mixture is from about 1:3 to 3:1 and the total amount of all sorbitan ester materials is from about 1% to about 15%.

10. A method of imparting a soft, smooth feeling to skin during and after skin cleansing, said method comprising:

A. applying to the skin an effective amount of a soap composition from a toilet bar, said bar comprising:

i. from about 65% to 90% by weight of a soap selected from the group consisting of alkali metal, ammonium and alkanolamine salts of fatty acids containing from about 8 to 24 carbon atoms;

ii. from about 1% to 15% by weight of a skin conditioning agent selected from the group consisting of ethoxylated sorbitan ester mixtures containing from one to 10 oxyethylene moieties at one or more of the unesterified —OH groups and non-ethoxylated sorbitan ester mixtures and combinations thereof, said mixtures comprising a. from about 5% to 50% by weight of mixture of mono-ester materials, b. from about 20% to 90% by weight of mixture of di-ester materials, and c. from about 0% to 60% by weight of mixture of tri- and tetra-ester materials; the ester moieties of the sorbitan esters in said mixtures being derived from fatty alkyl groups containing from about 12 to 22 carbon atoms; and iii. from about 4% to 25% by weight of moisture; and B. subsequently rinsing the skin with water.

11. A method in accordance with claim 10 a. wherein the soap component comprises i. sodium soap or mixtures of sodium and potassium soap with no more than 25% of the sodium/-potassium mixture being potassium soap; derived from ii. mixtures of tallow and coconut oil with tallow/-coconut weight ratios ranging between about 90:10 and 50:50; and b. wherein the sorbitan ester skin conditioning mixture i. comprises from about 20% to 40% by weight of mono-ester materials, from about 30% to 60% by weight of di-ester materials and from about 0% to 40% by weight of the mixture of tri- and tetra-ester materials; and ii. contains about 15% or less by weight of isosorbide esters and about 6% or less by weight sorbitol ester.

* * * * *